United States Patent [19]

Inaba et al.

[11] Patent Number: 4,822,301

[45] Date of Patent: Apr. 18, 1989

[54] CRT SOCKET

[75] Inventors: Hirobumi Inaba; Yasunori Nishikawa, both of Yao, Japan

[73] Assignee: Hosiden Electronics Co., Ltd., Osaka, Japan

[21] Appl. No.: 115,736

[22] Filed: Nov. 2, 1987

[30] Foreign Application Priority Data

Nov. 21, 1986 [JP] Japan ..... 61-179185

[51] Int. Cl.[4] ..... H01N 4/24

[52] U.S. Cl. ..... 439/436; 439/182

[58] Field of Search ..... 439/436–438, 439/491, 182, 375, 683

[56] References Cited

U.S. PATENT DOCUMENTS

| | | | |
|---|---|---|---|
| 4,199,215 | 4/1980 | Pittman | 439/182 |
| 4,573,755 | 3/1986 | Simovits, Jr. | 439/182 |

FOREIGN PATENT DOCUMENTS

| | | | |
|---|---|---|---|
| 0173790 | 3/1986 | European Pat. Off. | 439/182 |
| 1136393 | 9/1962 | Fed. Rep. of Germany | 439/436 |
| 751675 | 7/1956 | United Kingdom | 439/436 |

*Primary Examiner*—John D. Lee
*Assistant Examiner*—John Ngo
*Attorney, Agent, or Firm*—Pollock, VandeSande and Priddy

[57] ABSTRACT

A contact plate is provided in obliquely opposing relation to a flange part of a high-voltage side discharge electrode disposed in a high-voltage chamber of a CRT socket. A movable urging member is movable into and away from a place where the urging member presses the contact plate against the flange part. A lead insertion hole is bored through the high-voltage chamber above the contact plate so that a high-voltage lead can be inserted through the lead insertion hole into between the contact plate and the flange.

12 Claims, 6 Drawing Sheets

CRT SOCKET

BACKGROUND OF THE INVENTION

The present invention relates to a cathode ray tube socket comprising a socket part and a high-voltage chamber, and particularly to the type in which a high-voltage lead can be connected to a high-voltage discharge electrode housed in the high-voltage chamber.

A prior art cathode ray tube (hereinafter referred to as CRT) socket is disclosed in U.S. Pat. No. 4,649,315, in which a high-voltage terminal is provided so as to be connected to an external high-voltage lead by soldering. The soldering work is a nuisance, and once connected, disconnection is also a nuisance. Therefore, when repair was necessary, it was not unusual that the whole CRT socket was replaced by a new one, which was uneconomical.

SUMMARY OF THE INVENTION

An object of the present invention is to provide a CRT socket which allows easy connection of a high-voltage lead without soldering, and which allows easy disconnection of the connected high-voltage lead.

According to the present invention, a contact plate is disposed near and opposite a flange part of a high-voltage discharge electrode which is a high-voltage side one of two electrodes defining a high-voltage discharge gap therebetween, and a lead insertion hole is formed in an outer wall of the high-voltage chamber so that a high-voltage lead can be inserted from the outside through the lead insertion hole into between the flange part and the contact plate. The high-voltage chamber also has a pivotable urging member which presses the contact plate resiliently against the flange part, whereby the high-voltage lead can be gripped between the contact plate and the flange part, achieving good electrical connection.

DETAILED DESCRIPTION OF THE PREFERRED EMBODIMENTS

Figure 1:
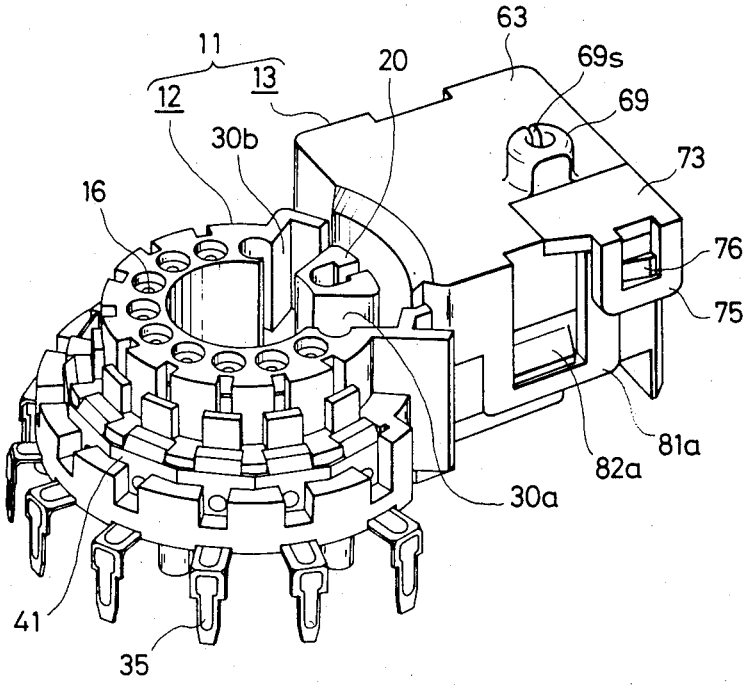
FIG. 1 is a perspective view showing an embodiment of a CRT socket according to the invention.

As shown in FIGS. 1 to 4, a body 11 of an insulating material comprises a socket part 12 for connection with terminal pins of a counterpart CRT, and a high-voltage chamber 13 provided at a side of the socket part 12 integrally therwith. The socket part 12 is substantially of cylindrical shape, the diameter of which increases stepwise on the rear side thereof (the lower side in FIG. 1), and has a circular front face in which are formed a plurality of insertion holes 16 for insertion thereinto of terminal pins of the CRT. A plurality of contact housing rooms 17 (FIGS. 3 and 4) are provided inside the socket part 12 in corresponding relation with the insertion holes 16. A plurality of contact pieces 18 are housed in the respective contact housing rooms 17. An intermediate portion of each contact piece 18 closes, from the inside, corresponding a one of through holes 25, which are formed in a circumferential wall of the socket part 12 to communicate radially with the respective contact housing rooms 17. A belt-like ground electrode 41 is provided around the circumferential wall to close, from the outside, the respective through holes 25, thus defining a discharge gap room in each of the closed through holes 25. A rear end of each contact piece 18 is led out as a terminal 35.

A high-voltage post 20 is defined adjacent the high-voltage chamber 13 by dividing the cylindrical portion of the socket part 12 by two valleys 30a, **30*b*. The high-voltage post 20 has a housing hole, in which is disposed a high-voltage contact 28*h*** for receiving therein a high-voltage terminal pin of the CRT.

Although only brief explanation has been given in the foregoing with respect to the structure of the socket part 12, the socket part 12 employed in the embodiment of CRT socket according to the invention is exactly the same as that disclosed in the aforementioned U.S. patent and, therefore, further detailed explanation will be omitted.

Figure 2:
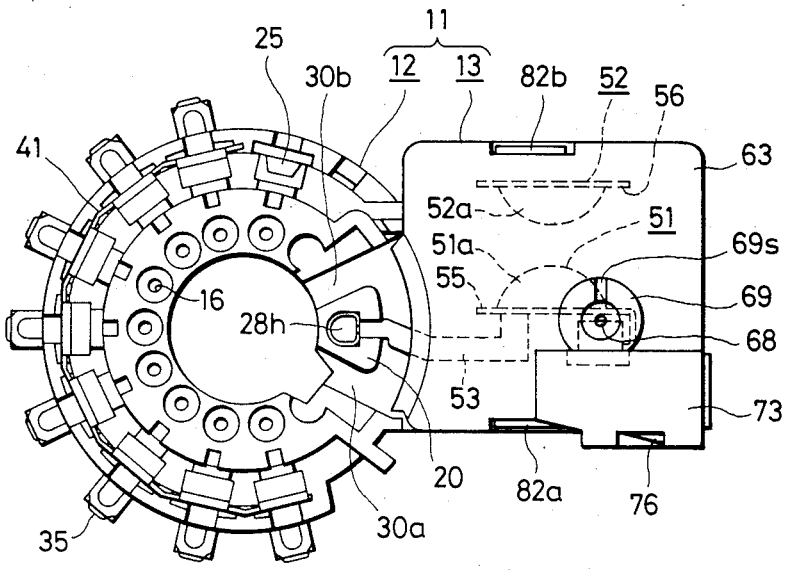
FIG. 2 is a plan view of the CRT socket shown in FIG. 1.
Figure 5:
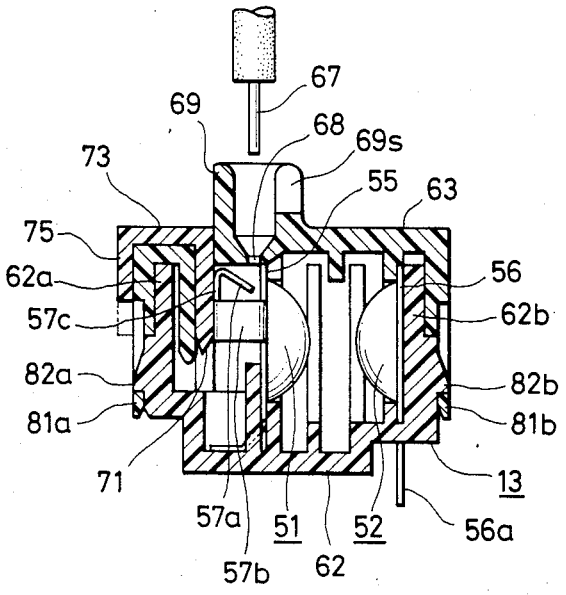
FIG. 5 is a cross-sectional view of a high-voltage chamber 13 shown in FIG. 3.
Figure 9:
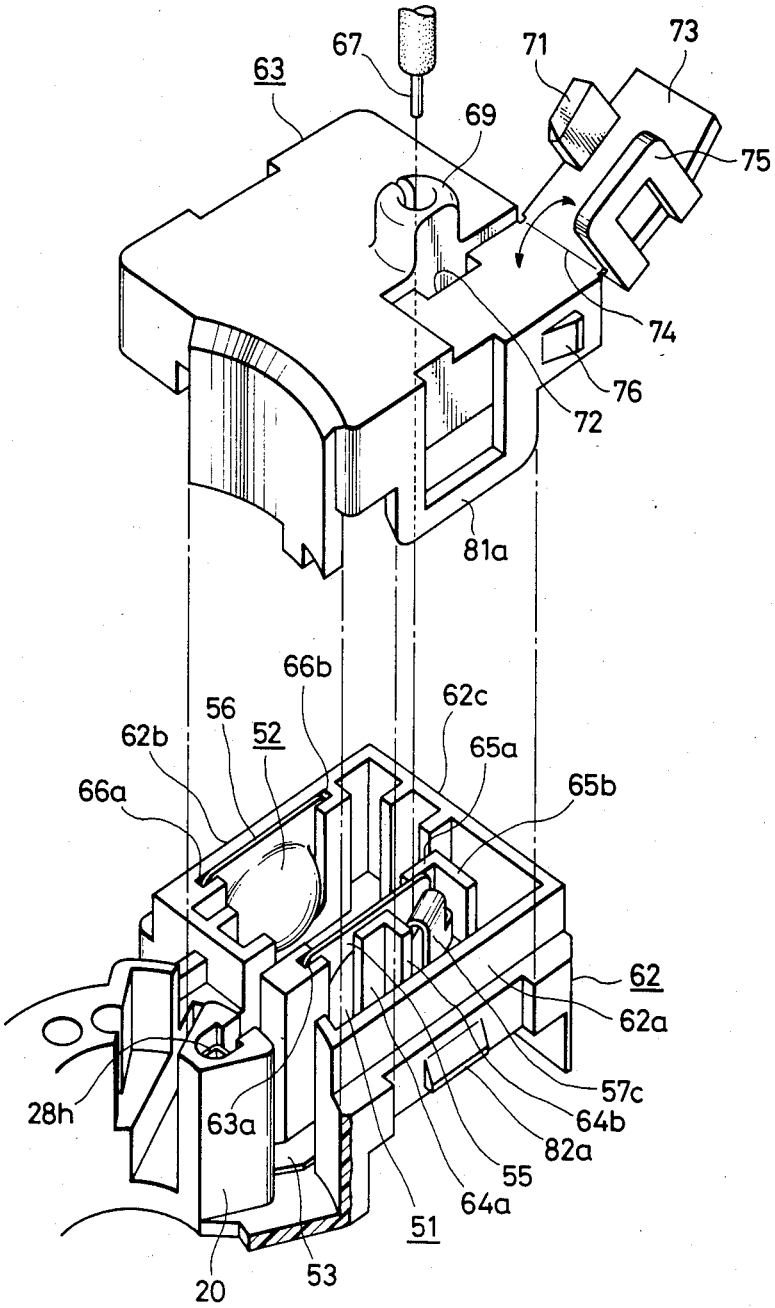
FIG. 9 is a perspective view showing a container part 62 and a cover 63, separately, with a pivotal plate 73 in open state.

As shown in FIGS. 2, 5 and 9, the high-voltage chamber 13 houses therein a pair of high-voltage discharge electrodes 51 and 52 having semispherical parts **51*a* and 52*a* defining a high-voltage discharge gap therebetween. The electrode 51 is connected integrally with the high-voltage contact 28*h* in the post 20 via a connecting conductor 53, and is thus referred to as a high-voltage side electrode. The opposite electrode 52 is called a ground side electrode. The electrodes 51 and 52 are provided with square flange parts 55 and 56 around their semispherical parts 51*a*, 52*a*, and opposite sides of each of the flange parts 55, 56 are fitted in grooves formed in inner wall surfaces of the high-voltage chamber 13**.

Figure 6:
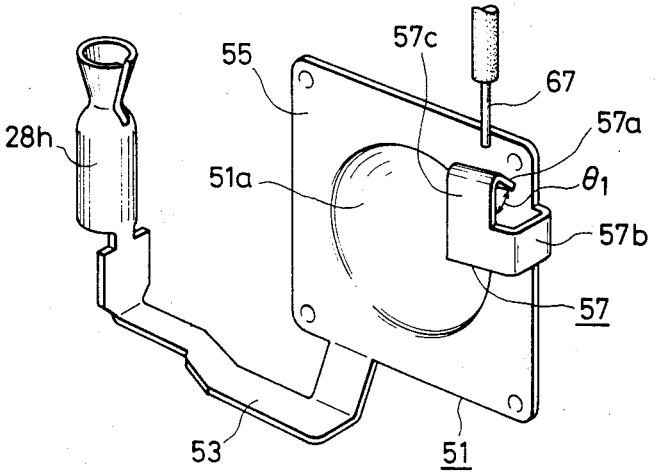
FIG. 6 is a perspective view showing an integral structure of a high-voltage contact **28*h* and a high-voltage discharge electrode 51**.

As shown in FIGS. 5 and 6, according to the invention, a contact plate **57*a* is provided in closely opposing relation to the flange part 55 of the high-voltage side electrode 51. In more specific, an L-shaped arm plate 57 is formed to extend integrally from an edge of the flange part 55. The L-shaped arm plate 57 is bent near the edge of the flange part 55 through about a right angle in a direction opposite from the spherical projection of the electrode 51, and is further bent inwardly at an intermediate portion of the base part of the L forming a connecting portion 57*b* to define a receiver plate 57*c* facing the back side of the flange part 55 in a slightly oblique relation thereto. The receiver plate 57*c* includes an upright part of the L, an intermediate portion of which is bent to define the contact plate 57a so that the contact plate 57a forms an acute angle with respect to the flange part 55 on the side where the high-voltage lead 67** will be inserted.

Figure 7A:
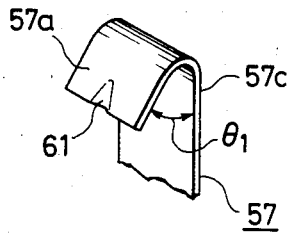
FIG. 7A is a perspective view of part of an arm plate 57 seen from an opposite direction in FIG. 6.
Figure 7B:
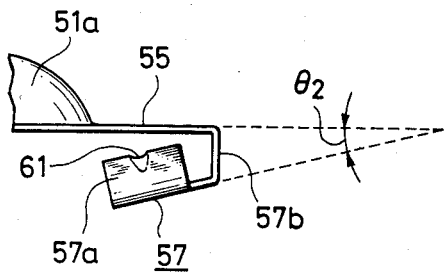
FIG. 7B is a plan view of the arm plate 57.

As shown in FIG. 7A, a triangular taper groove 61 may be cut in a tip edge of the contact plate 57a at the center thereof. The triangular taper groove 61 serves to position and guide the high-voltage lead 67.

Figure 3:
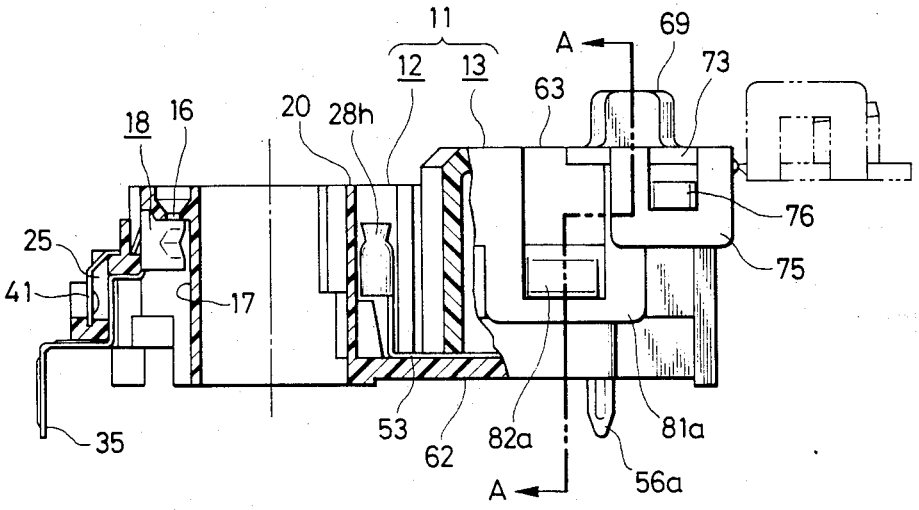
FIG. 3 is a front view of the CRT socket with a socket part 12 in cross-section.
Figure 4:
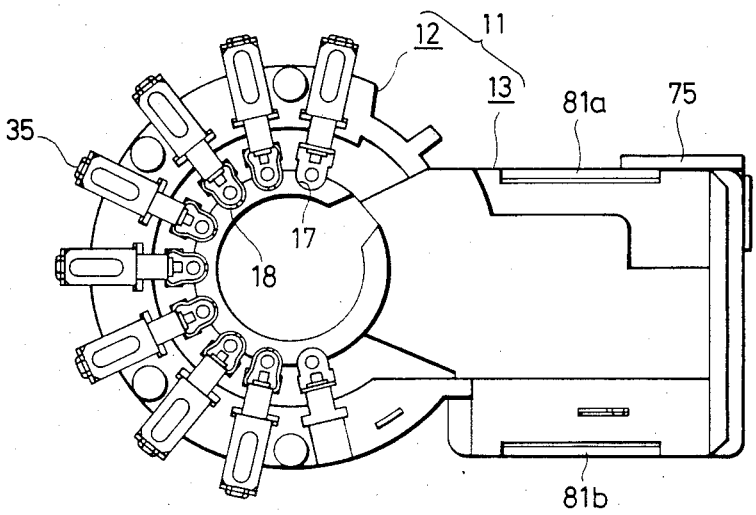
FIG. 4 is a bottom view of FIG. 1.
Figure 8:
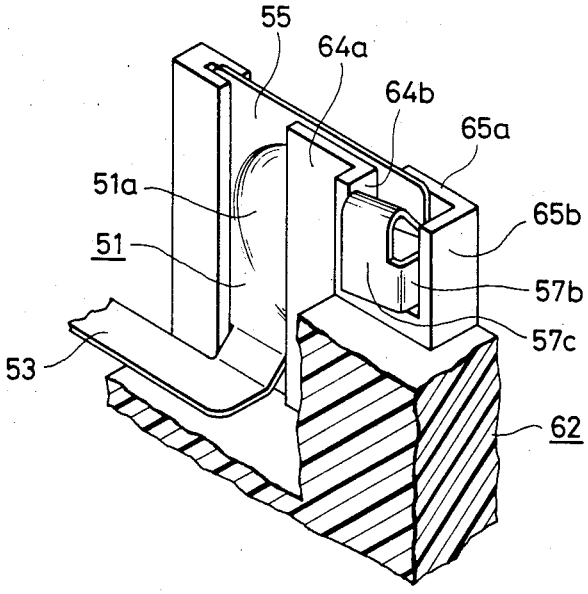
FIG. 8 is a perspective view showing the holding state of a flange part 55.

As shown in FIGS. 3, 5 and 9, the high-voltage chamber 13 comprises a box-shaped container part 62 formed integrally with the socket part 12 and a cover 63 for closing a front opening of the containing part 62. Support walls 64a, 65a are formed integrally with the container part 62 to hold the flange part 55 of the electrode 51. In the embodiment shown in FIG. 8, these support walls 64a, 65a have guide walls 64b, 65b formed integrally therewith in orthogonal relation thereto, whereby displacement of the receiver plate 57c in the the widthwise direction thereof is limited. The flange part 56 of the ground side discharge electrode 52 is fitted in support grooves 66a, 66b defined in a side wall 62b of the container part 62, with a ground terminal 56a of the electrode 52 being extended integrally from an edge of the flange part 56 thereof to the outside through a bottom wall of the container part 62.

As shown in FIG. 5, a lead insertion hole 68 is bored through the cover 63 in opposing relation to the triangular taper groove 61 so that the high-voltage lead 67 can be inserted from the outside into between the flange part 55 and the contact plate 57a. If desired, a sleeve 69 may be formed on the outer surface of the cover 63 integrally therewith in concentric relation to the lead insertion hole 68 so that an end portion of an outer sheath of the high-voltage lead 67 can be fitted in the sleeve 69. Further, a slit 69s may be cut in the sleeve 69 in its axial direction to provide resilient gripping force.

An urging member 71 is provided as shown in FIGS. 5 and 9 to urge the contact plate 57a resiliently against the flange part 55 with the high-voltage lead 67 having been inserted in between the flange part 55 and the contact plate 57a through the lead insertion hole 68. The urging member 71 is formed integrally with a pivotable plate 73 to extend perpendicularly therefrom, and the pivotable plate 73 is pivotably connected along one edge thereof with a front side edge of the cover 63 via a hinge 74 formed integrally therewith. A slot 72 is cut in the cover 63 near the sleeve 67 to locate almost above the bent portion between the contact plate 57a and the receiver plate 57c when the cover 63 is mounted on the container part 62. When the pivotable plate 73 is pivoted to abut against a front face of the cover 63, that is, when the pivotable plate 73 is brought into a closed state, the urging member 71 enters the slot 72 and pushes the receiver plate 57c aside towards the flange part 55, thus clipping the high-voltage lead 67 between the contact plate 57a and the flange part 55 and achieving a good electrical connection between the high-voltage lead 67 and the electrode 51. A suitable selection of an angle between the contact plate 57a and the flange part 55 can provide a strong resistive force against pulling out of the high-voltage lead 67. A U-shaped piece 75 is formed integrally with the pivotable plate 73 so as to engage with a protuberance 76 formed on an outer side surface of the cover 63 when the pivotable plate 73 is closed. The cover 63 also has U-shaped locking pieces 81a and 81b on both sides thereof for engagement with locking ridges 82a and 82b formed on the outer surfaces of the side walls 62a and 62b of the container part 62.

Since the angle $\theta_1$ between the contact plate 57a and the receiver plate 57c can be resiliently varied as seen in FIGS. 6 and 7A, it is also possible to insert the high-voltage lead 67 into between the flange part 55 and the contact plate 57a even after closing the pivotable plate 73 to resiliently press the contact plate 57a against the flange part 55 with the urging member 71. Moreover, since the angle $\theta_2$ between the receiver plate 57c and the flange part 55 can be resiliently varied, the receiver plate 57c can assume its initial posture after removal of the inserted urging member 71, allowing easy pulling out of the high-voltage lead 67.

Figure 10:
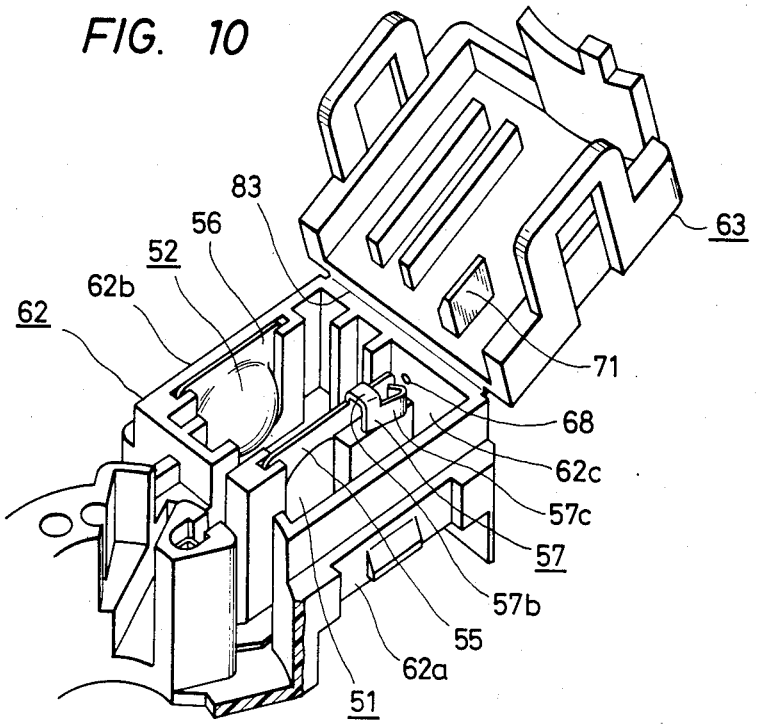
FIG. 10 is a perspective view showing a high-voltage chamber of another embodiment of the invention.

FIG. 10 shows an embodiment which is arranged so that the high-voltage lead 67 can be inserted through a lead insertion hole 68 in a side wall 62c of the container part 62. In this embodiment, a pivotable plate such as the plate 73 employed in FIG. 9, for example, is not provided. Instead, the cover 63 itself acts as the pivotable plate. The cover 63 is formed integrally with the side wall 62c of the container part 62 opposite the socket part 12 and is pivotable about a hinge 83 defined between the cover 63 and the side wall 62c. The urging member 71 is formed integrally with the cover 63 to project from the inner surface thereof. Accordingly, in this embodiment, the urging member 71 can be disposed behind the receiver plate 57c by closing the cover 63 through pivotal movement thereof. Of course, a pivotable plate with the urging member 71 such as shown in FIG. 9 may be provided on the outer surface of the cover 63. In the embodiment of FIG. 10, the L-shaped arm plate 57 defining the contact plate 57a, the connecting portion 57b and the receiver plate 57c is formed integrally with the flange part 55 to extend from upper side edge thereof. The lead insertion hole 68 for guiding the high-voltage lead 67 into between the contact plate 57a and the flange part 55 is bored through the side wall 62c of the container part 62. Although not seen in FIG. 10, a sleeve 69 is provided on the outer surface of the side wall 62c in a manner similar to that shown in FIGS. 2, 3 and 5. In order to disconnect the high-voltage lead 67 which has been engaged between the edge of the contact plate 57a and the flange part 55, it is only necessary to open the cover 63 so as to bring the urging member 71 away from the receiver plate 57c.

Figure 11:
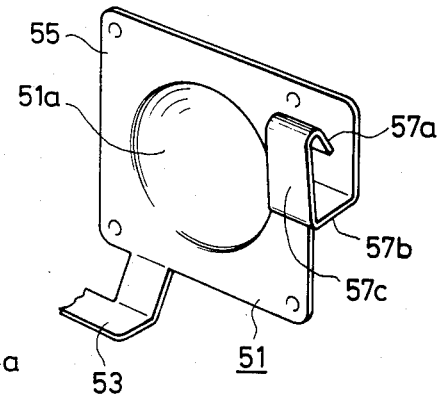
FIG. 11 is a perspective view showing a modification of the high-voltage discharge electrode 51.
Figure 12:
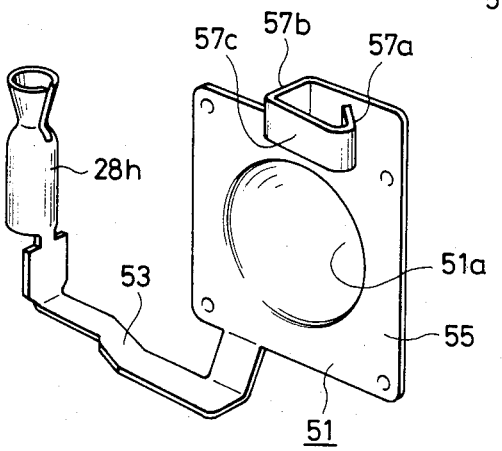
FIG. 12 is a perspective view showing another modification of the high-voltage discharge electrode 51.

FIGS. 11 and 12 show other examples of arm plates 57 which are formed integrally with the flange part 55 of the high-voltage discharge electrode 51. The electrode 51 shown in FIG. 11 is a modification of the electrode 51 shown in FIG. 6, and is used for the type of CRT socket where a high-voltage lead 67 will be inserted through the hole 68 in the cover 63 shown in FIG. 9, for example. In contrast, the electrode 51 shown in FIG. 12 is a modification of the one seen in FIG. 10, which is used for the type of CRT socket where a high-voltage lead 67 will be inserted through the hole 68 in the side wall 62c of the container part 62. In each example, the arm plate 57 is formed by cutting one marginal side of the flange part 55 in parallel relation to the side edge thereof to an intermediate position and then bending the strip-like arm plate in a folding manner to define the contact plate 57a, connecting portion 57b and receiver plate 57c.

As explained in the foregoing, the CRT socket according to the present invention enables electrical connection between the high-voltage contact 28h and the high-voltage lead 67 by simple insertion of the latter. Moreover, the urging member 71 presses the contact plate 57a against the flange part 55, assuring both electrical connection and holding of the high-voltage lead 67. In addition, the lead 67 can be easily disconnected when desired by pivoting the urging member 71. Accordingly, the CRT socket according to the present invention requires simpler work than the prior art CRT socket does for electrically connecting the high-voltage lead and the high-voltage contact. Further, the easy removal of high-voltage lead according to the present invention avoids melting of a soldered connection or replacement of the CRT socket in use with a new one each time associated parts or circuits are repaired. Moreover, both the integral structure of the contact plate 57*a* and the high-voltage electrode 51 and the integral structure of the cover 63 and the urging member 71 serve to reduce the number of parts constituting the CRT socket according to the present invention.

What is claimed is:

1. A CRT socket comprising:

a socket part for receiving terminal pins of a CRT;

a high-voltage chamber provided adjacent a side of said socket part, said high-voltage chamber comprising a box-shaped container part formed integrally with said socket part, and a cover for closing a front opening of said container part;

a pair of high-voltage discharge electrodes disposed in said high-voltage chamber in opposing relation to each other to define a high-voltage discharge gap therebetween, one of said pair of electrodes being a high-voltage side electrode and the other being a ground side electrode, the high-voltage side electrode having a flange part;

a contact plate disposed near said flange part in obliquely opposing relation thereto;

a lead insertion hole bored through said high-voltage chamber, for introducing therethrough a high-voltage lead from the outside to a place between said contact plate and said flange part; and an urging member provided on said cover and movable into a position for resiliently pressing said contact plate against said flange part.

2. A CRT socket according to claim 1, wherein said lead insertion hole is formed in said cover.

3. A CRT socket according to claim 2, comprising a pivotable plate formed integrally with said cover via a hinge formed along one front edge of said cover so that said pivotable plate can be brought into abutment with a front face of said cover, said urging member extending integrally from said pivotable plate, and a slot in said cover for passing therethrough said urging member to push aside said contact plate towards said flange part.

4. A CRT socket according to claim 3, wherein said pivotable plate has a locking piece formed integrally therewith for engagement with a protuberance formed on said cover in a state when said pivotable plate is in abutment with said cover.

5. A CRT socket according to claim 1, wherein said lead insertion hole is bored through a side wall of said container part.

6. A CRT socket according to claim 5, wherein said cover is formed integrally with the side wall of said container part, said cover being pivotable about a hinge defined between said cover and said side wall.

7. A CRT socket according to claim 6, wherein said urging member is formed on an inner surface of said cover integrally therewith.

8. A CRT socket comprising;

a socket part for receiving terminal pins of a CRT;

a high-voltage chamber provided adjacent a side of said socket part;

a pair of high-voltage discharge electrodes disposed in said high-voltage chamber in opposing relation to each other to define a high-voltage discharge gap therebetween, one of said pair of electrodes being a high-voltage side electrode and the other being a ground side electrode, the high-voltage side electrode having a flange part;

a contact plate disposed near said flange part in obliquely opposing relation thereto;

a lead insertion hole bored through said high-voltage chamber, for introducing therethrough a high-voltage lead from the outside to a place between said contact plate and said flange part; and an urging member movable into a position for resiliently pressing said contact plate against said flange part;

said contact plate being formed by bending an arm plate extending integrally from an edge of said flange part.

9. A CRT socket according to claim 8, comprising a sleeve formed on said high-voltage chamber in concentric relation with said lead insertion hole, for receiving therein an end portion of an outer sheath from which the high-voltage lead extends.

10. A CRT socket according to claim 9, wherein said sleeve has a slit cut therein in the lengthwise direction thereof.

11. A CRT socket according to claim 8, comprising support walls formed in said high-voltage chamber integrally therewith, for limiting lateral movement of said contact plate.

12. A CRT socket according to claim 8, wherein a guide groove is formed in a end portion of said contact plate in opposing relation to said flange part.

* * * * *